US006960067B2

(12) United States Patent
Jung et al.

(10) Patent No.: US 6,960,067 B2
(45) Date of Patent: Nov. 1, 2005

(54) RECIPROCATING COMPRESSOR HAVING AN INNER CORE WITH A SCRATCH RESISTANT INTERMEDIATE MEMBER

(75) Inventors: Won-hyun Jung, Changwon (KR); Seong Yeol Hyeon, Changwon (KR); Gyoo Jong Bae, Changwon (KR); Jang Whan Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 134 days.

(21) Appl. No.: 10/276,963

(22) PCT Filed: Mar. 24, 2001

(86) PCT No.: PCT/KR01/00480

§ 371 (c)(1),
(2), (4) Date: Nov. 21, 2002

(87) PCT Pub. No.: WO02/077455

PCT Pub. Date: Oct. 3, 2002

(65) Prior Publication Data

US 2004/0022650 A1 Feb. 5, 2004

(51) Int. Cl.[7] ..... F04B 17/04

(52) U.S. Cl. ..... 417/417; 417/416; 417/415; 310/14; 310/15; 310/36; 310/217; 310/254

(58) Field of Search ..... 417/415, 416, 417/417; 310/12, 13, 14, 15, 36, 216, 217, 91, 67 R, 254

(56) References Cited

U.S. PATENT DOCUMENTS 5,195,231 A * 3/1993 Fanning et al. ..... 29/596
5,315,190 A * 5/1994 Nasar ..... 310/12
6,238,192 B1 * 5/2001 Lee ..... 417/417
6,273,688 B1 * 8/2001 Kawahara et al. ..... 417/417
6,339,876 B1 * 1/2002 Lee ..... 29/888.02
6,365,999 B1 * 4/2002 Muhlberger et al. ..... 310/254
6,398,523 B1 * 6/2002 Hur et al. ..... 417/417
2003/0193260 A1 * 10/2003 Reiter et al. ..... 310/217

FOREIGN PATENT DOCUMENTS

KR 98-17653 A 6/1998
KR 98-50606 A 9/1998
KR 99-2718 A 10/1999
KR 2001-7635 A 1/2001

* cited by examiner

*Primary Examiner*—Cheryl Tyler
*Assistant Examiner*—Emmanuel Sayoc
(74) *Attorney, Agent, or Firm*—Birch, Stewart, Kolasch & Birch, LLP

(57) ABSTRACT

A reciprocating compressor comprises an inside stator formed by piling a plurality of stator cores to have an actinomorphic cylinder shape, which is press-fitted to a frame, and a streak protection member and a burr shielding ring installed between the inner aspect of the inside stator and corresponding outer aspect of the frame. Thereby the burr generating between the frame and the inner stator by a streak is prevented previously, and even if a burr is generated, this burr is locked in a burr escape unit in the burr-shielding ring. Therefore degrading of valve function and an abrasion of a sliding unit in a compressing unit by the burr generating is prevented and the vibration noise of the compressor is reduced by assembling the frame and the inside stator strongly.

6 Claims, 7 Drawing Sheets

RECIPROCATING COMPRESSOR HAVING AN INNER CORE WITH A SCRATCH RESISTANT INTERMEDIATE MEMBER

This application is the national phase under 35 U.S.C. §371 of PCT International Application No. PCT/KR01/00480 which has an International filing date of Mar. 24, 2001, which designated the United States of America.

TECHNICAL FIELD

The present invention relates to a reciprocating compressor, and particularly, to a reciprocating compressor having an inner stator fixing structure in which an inner stator is mounted on a frame and on an inner stator through path pipe.

BACKGROUND ART

Generally, a compressor is for changing a mechanical energy into a compressed energy of compressive fluid, and the compressor can be divided into reciprocating type, scroll type, centrifugal type, and vane type compressors.

The reciprocating compressor can be divided into a type in which a driving axis is coupled to an armature of a rotary type driving motor and rotating movements of the driving axis is changed into linear movements of a piston to compress gas, and a type in which a piston instead of the driving axis is coupled to the armature of a reciprocating motor performing linear movements and the piston undergoes the linear reciprocating movements to compress refrigerant.

FIG. 1 is showing an example of the latter reciprocating compressor between above two types.

As shown therein, the conventional reciprocating compressor comprises a compression unit C installed inside a casing V, in which oil is filled on the bottom therein, in a transverse direction for sucking, compressing, and discharging the refrigerant, and an oil feeder O fixed on outer side of the compression unit C for providing a sliding portion with oil.

The compression unit C comprises a frame 1 of annular shape; a cover 2 fixed on one side surface of the frame 1; a cylinder 3 fixed on a center part of the frame 1 in a transverse direction; an inner stator 4A fixed on an outer circumferential surface of the frame 1 supporting the cylinder 3; an outer stator 4B fixedly installed on an outer circumferential surface of the inner stator 4A with a predetermined air gap for forming induced magnetism with the inner stator 4A; an armature 5 disposed on the air gap between the inner and outer stators for performing linear reciprocating movements; a piston 6 fixed integrally on the armature 5 for sucking and compressing refrigerant gas as sliding in the cylinder 3; and an inner resonant spring 7A and an outer resonant spring 7B for inducing the armature 5 to perform the resonant movements on the air gap between the inner/outer stators continuously.

On the other hand, as shown in FIG. 2, the inner stator 4A is formed as a hollow cylinder in which a plurality of stator cores 4*a* are laminated as one by one or as bunches, and an inner circumferential surface thereof is press-fitted into the outer circumferential surface of the frame 1, that is, the outer circumferential surface of a boss portion 1*a* in which the cylinder is inserted.

Unexplained reference numeral 8 represents a discharge valve, and 9 represents a suction pipe.

The conventional reciprocating compressor as constructed above is operated as follows.

That is, when an electric current is applied to the stator in the reciprocating compressor comprising the inner stator 4A and the outer stator 4B to generate the induced magnetism, the armature 5 disposed between the above stators undergoes linear reciprocating movements by the inner/outer resonant springs 7A and 7B and the piston 6 undergoes linear reciprocating movements inside the cylinder 3. In addition, according to that the piston 6 undergoes the linear reciprocating movements inside the cylinder 3, the refrigerant gas flowing into the casing V is compressed inside the cylinder and is discharged as pushing a discharge valve assembly 8.

However, in the above inner stator fixing structure of the conventional reciprocating compressor, the inner stator is formed by laminating thin stator cores in a radial direction to be a hollow cylinder shape and one side end of the laminated inner stator is put into the frame to be contacted to the outer circumferential surface of the boss portion for cylinder insertion. Therefore, the inner stator scratches the outer circumferential surface of the boss portion for cylinder insertion on the frame to generate burr. In addition, the burr is induced into the compression chamber with the oil filled in the casing and attached to the valve, and the opening/closing operations of the valve are not made smoothly. Otherwise, the burr is induced into the sliding portion, and therefore, abrasion on the cylinder or piston performing the linear reciprocating movements.

Also, the outer circumferential surface of the boss portion on the frame is worn by the scratches, and accordingly, the inner stator is loosen and the vibration noise of the compressor is also increased.

DETAILED DESCRIPTION OF THE INVENTION

Therefore, an object of the present invention is to provide a reciprocating compressor which is able to prevent a valve from being damaged by making burr not to generate during press-fitting an inner stator into a frame, and to prevent previously a piston or a cylinder from being damaged caused by inflow of the burr into a sliding portion.

Also, another object of the present invention is to provide a reciprocating compressor which is able to reduce vibration noise generated by that the coupling status of the frame and the inner stator is loosen during operating the compressor by fixing the frame and the inner stator firmly.

In order to achieve the above objects, there is provided a reciprocating compressor, in which a plurality of stator cores are laminated in radial direction as a hollow cylinder shape to form an inner stator, comprising an intermediate member between the inner stator and a supporting member supporting the inner stator for preventing mutual abrasion.

MODE FOR CARRYING OUT THE PREFERRED EMBODIMENTS

Figure 1:
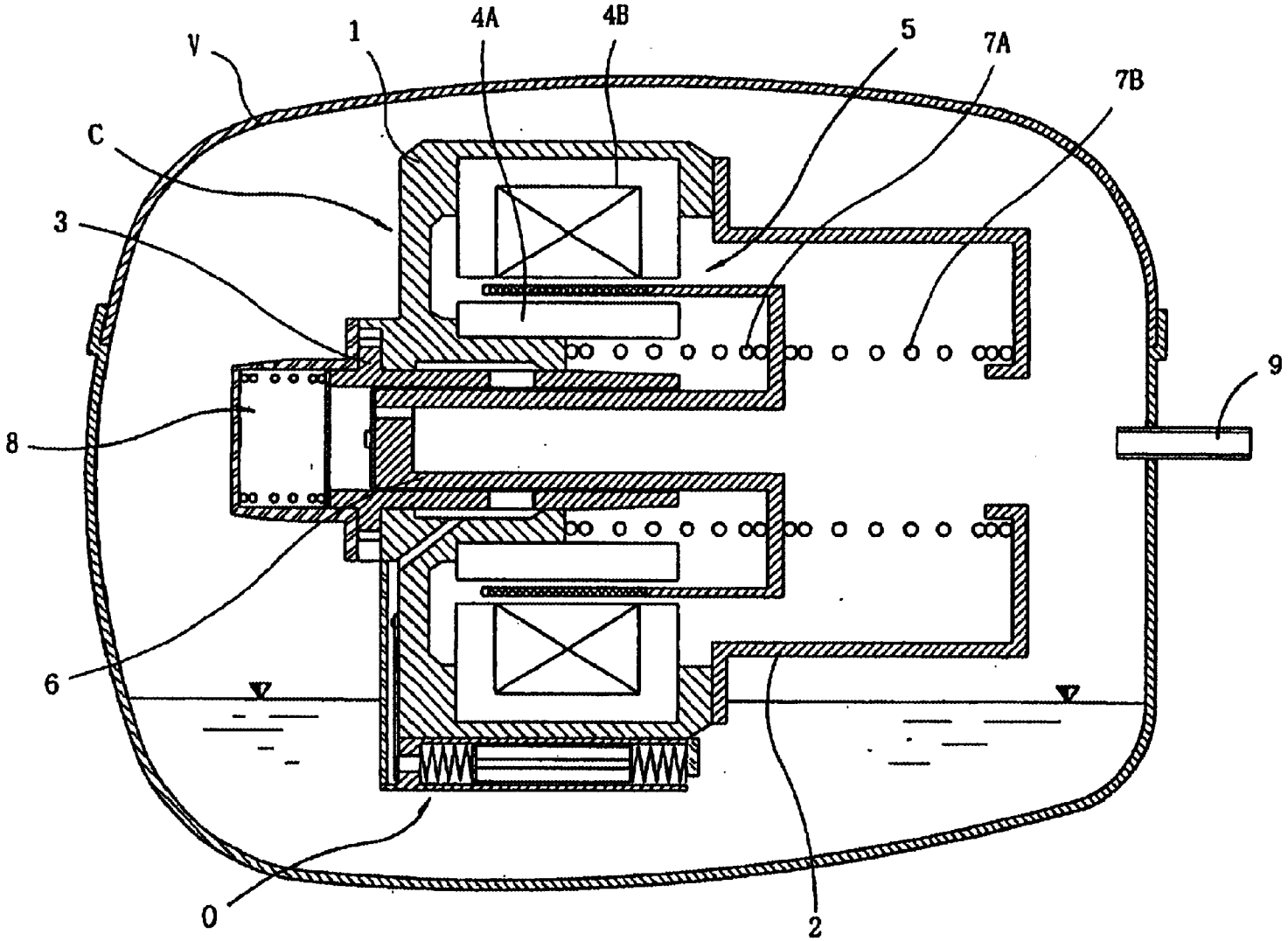
FIG. 1 BACKGROUND ART
FIG. 1 is a longitudinal cross-sectional view showing a conventional reciprocating compressor.
Figure 2:
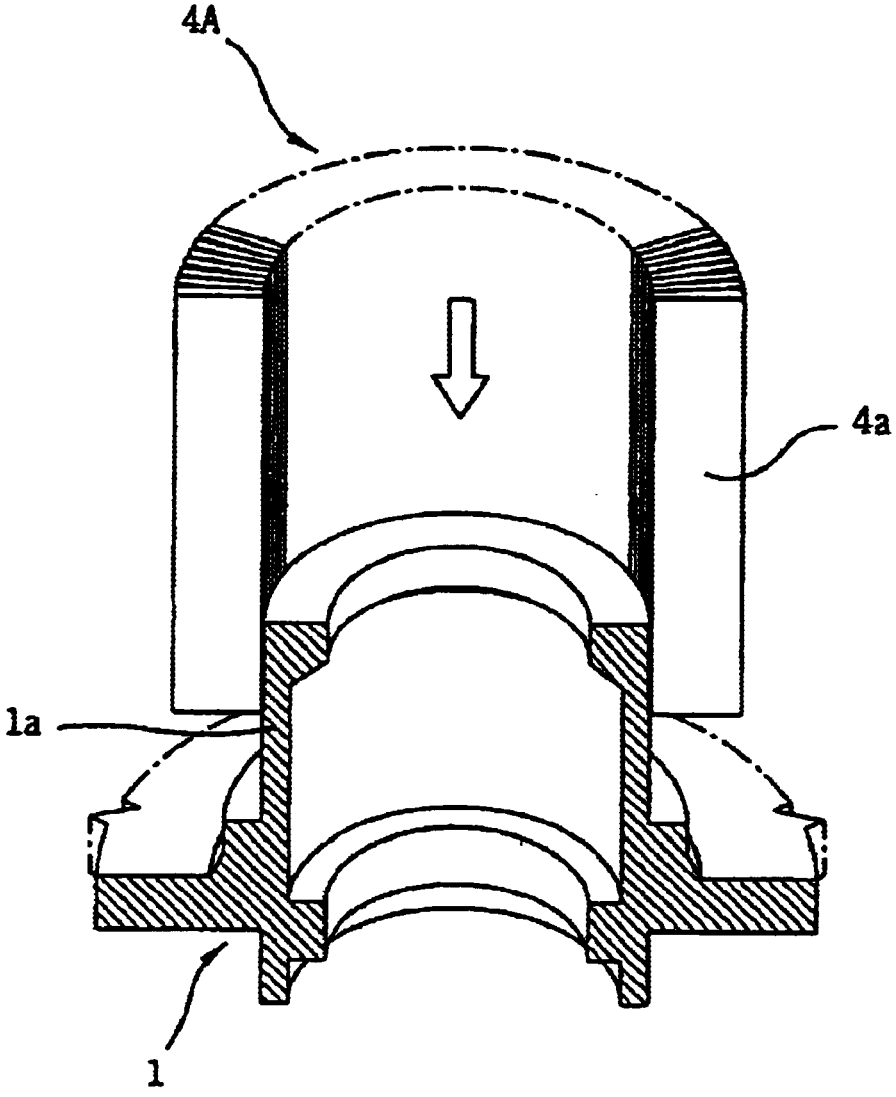
FIG. 2 BACKGROUND ART
FIG. 2 is a half-perspective view showing a process for mounting an inner stator in the conventional reciprocating compressor.

A first embodiment of an inner stator fixing structure of a reciprocating compressor according to the present invention will now be described with reference to accompanying Figures.

For same components as those of the conventional art, same reference numerals are used, and descriptions for same operations are omitted.

Figure 3:
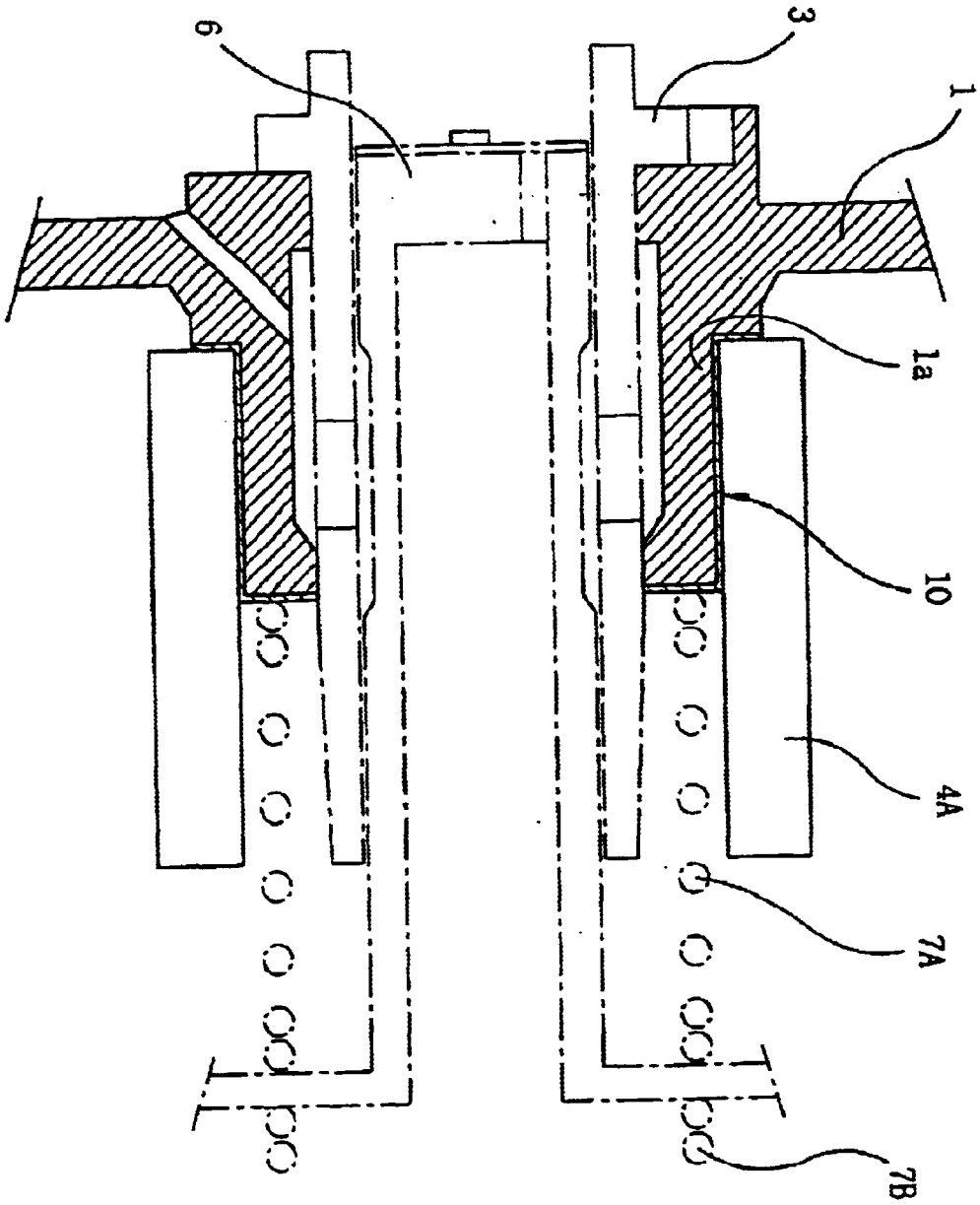
FIG. 3 is a longitudinal cross-sectional view showing a fixed structure of the inner stator applied by a first embodiment of a reciprocating compressor according to the present invention.
Figure 4:
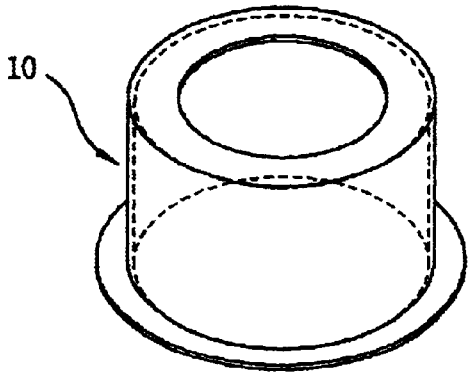
FIG. 4 is a perspective view showing a scratch protection cap of the reciprocating compressor according to the present invention.

As shown in FIGS. 3 and 4, a compression unit of a reciprocating compressor comprising an inner stator fixing structure according to the present invention comprises: a cylinder 3 fixed on a center of a frame 1; an inner stator 4A fixedly inserted into an outer circumferential surface of the frame 1; an outer stator (not shown) fixed on the frame 1 with a predetermined air gap on outer side of the inner stator 4A; an armature (not shown) disposed between the inner stator 4A and the outer stator (not shown) so as to perform linear reciprocating movements; a piston 6, which slides inside the cylinder 3, fixed integrally on the armature (not shown); and an inner resonant spring 7A and an outer resonant spring 7B for inducing the armature (not shown) to perform resonating movements continuously on the air gap between the inner and outer stators.

The inner stator 4A is formed as a cylinder by laminating a plurality of thin stator cores 4*a* in a radial direction. And the inner stator 4A is press-fitted so that an inner circumferential surface thereof faces with an outer circumferential surface of a boss portion 1 a for cylinder insertion on the frame 1. At that time, a scratch protection cap 10 for preventing the outer circumferential surface of the frame 1 from being scratched is disposed between the outer circumferential surface of the boss portion 1*a* for cylinder insertion and the inner circumferential surface of the inner stator 4A corresponding thereto.

The scratch protection cap 10 may be formed as a cylinder so as to cover entire area where the frame 1 and the inner stator 4A are contacted, or may include an introversion incurvation portion on an inlet portion side so that the inner stator 4A can be fitted easily.

Also, it is desirable that the scratch protection cap 10 is formed using a silicon steel plate which is same material as that of the inner stator 4A so as not to be worn by the inner stator 4A, considering that the frame 1 is generally made of aluminum and the inner stator 4A is made of the silicon steel plate harder than the frame 1.

Processes for assembling the inner stator on the frame in the first embodiment of the reciprocating compressor including the inner stator fixing structure according to the present invention will be described as follows.

Figure 5:
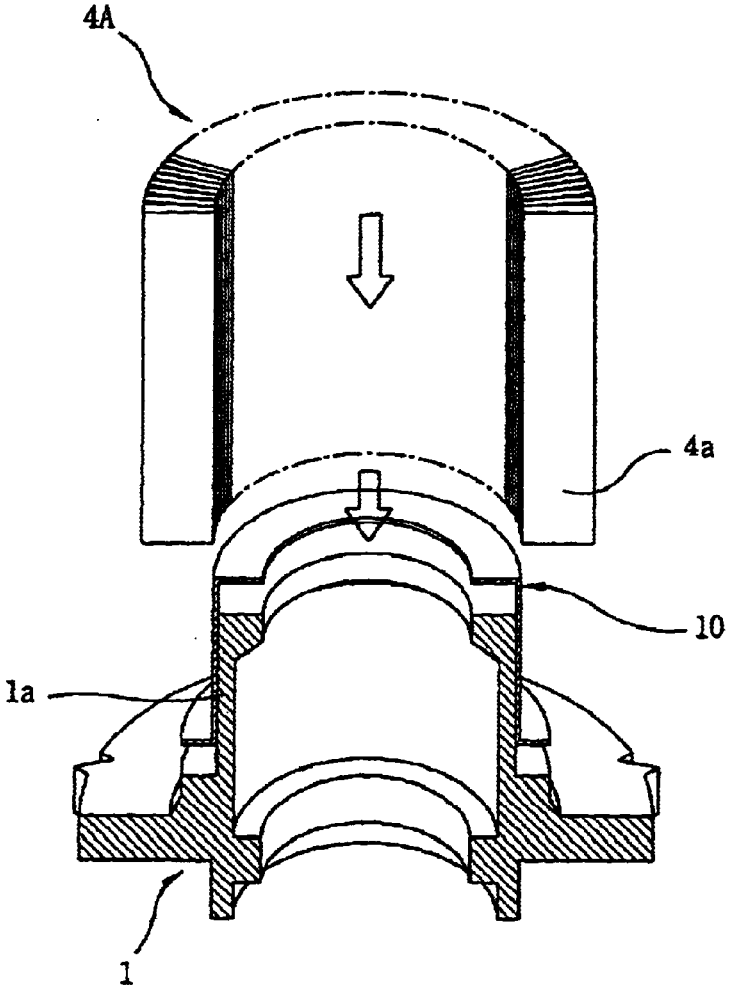
FIG. 5 is a half-perspective view showing a process for mounting the inner stator of the reciprocating compressor according to the present invention.

As shown in FIG. 5, the scratch protection cap 10 is press-fitted on the outer circumferential surface of the boss portion 1*a* for cylinder insertion on the frame, and then, the inner stator 4A in which stator cores 4*a* including a plurality of thin plates are laminated in a radial direction is press-fitted on the outer circumferential surface of the scratch protection cap 10 as described above.

At that time, the scratch protection cap 10 includes the introversion incurvation portion on the inlet portion thereof, and therefore, the inner circumferential surface of the inner stator 4A is inserted as sliding on the outer circumferential surface of the introversion incurvation portion in fitting the inner stator 4A. Thus, the fitting operation of the inner stator 4A can be performed smoothly.

As described above, the scratch protection cap 10 of same material as that of the inner stator 4A is disposed between the inner circumferential surface of the inner stator 4A and the outer circumferential surface of the frame 1 on which the inner stator 4A is fitted so as to prevent the scratch, and thereby, the burr generation which is generated by the scratch on the outer circumferential surface of the frame 1 in fitting the inner stator 4A into the frame 1 can be prevented.

Also, since the outer circumferential surface of the frame 1 is not worn in the process of press-fitting the inner stator 4A into the frame 1, the original fabrication level can be maintained and the frame 1 and the inner stator 4A can be assembled firmly.

Hereinafter, a second embodiment of the inner stator fixing structure in the reciprocating compressor according to the present invention will be described in more detail with reference to accompanying Figures.

Figure 6:
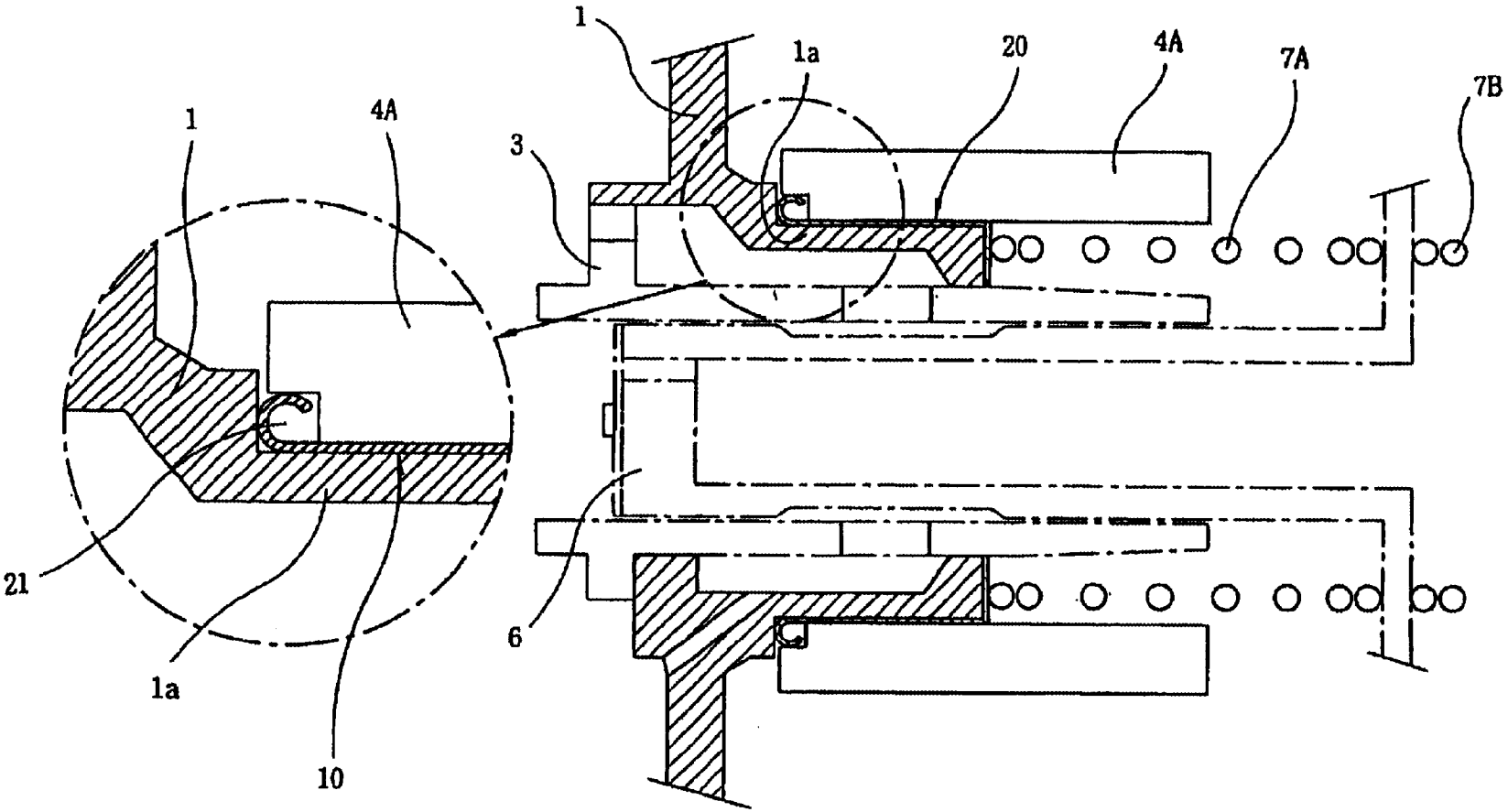
FIG. 6 is a longitudinal cross-sectional view showing a fixed structure of the inner stator applied by a second embodiment of a reciprocating compressor according to the present invention.
Figure 7:
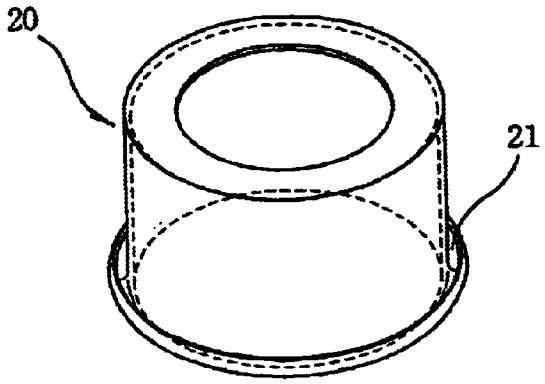
FIG. 7 is a perspective view showing a burr shielding ring of the reciprocating compressor according to the present invention.

As shown in FIGS. 6 and 7, the inner stator 4A is formed as a cylinder by laminating a plurality of thin stator cores 4*a* in radial direction, and is press-fitted into the frame 1 so that the inner circumferential surface of the inner stator 4A faces the outer circumferential surface of the boss portion 1 a for cylinder insertion on the frame 1. At that time, a burr shielding ring 20, which is able to prevent the outer circumferential surface of the frame from being scratched and at the same time, is able to collect and receive the burr even if the burr is generated by the scratch, is disposed between the outer circumferential surface of the boss portion 1*a* for cylinder insertion on the frame 1 and the inner circumferential surface of the inner stator 4A corresponding thereto.

The burr shielding ring 20 is formed as a cylinder so as to cover the entire portion where the frame 1 and the inner stator 4A are contacted to each other, and a burr escape unit 21 which is rolled toward outer side and has an opened end is formed on a rear end portion of the burr shielding ring 20 so as to collect and lock the burr therein.

Also, it is desirable that the burr shielding ring 20 is formed using a silicon steel plate which is same material as that of the inner stator 4A so as not to be worn by the inner stator 4A, considering that the frame 1 is generally made of aluminum and the inner stator 4A is made of the silicon steel plate harder than the frame 1.

Processes for assembling the inner stator on the frame in the second embodiment of the reciprocating compressor comprising the inner stator fixing structure according to the present invention are same as those of the first embodiment.

During assembling, the inner circumferential surface of the inner stator 4A is inserted as compacting with the outer circumferential surface of the burr shielding ring 20 which is fitted on the outer circumferential surface of the frame 1. Although the burr is little generated since the materials of the burr shielding ring 20 and the inner stator 4A are same as each other, fine burr may be generated due to the sharp end of the inner stator 4A. And the burr is pushed into the burr escape unit 21 of the burr shielding ring 20 and locked therein.

That is, the burr shielding ring 20 made of same material as that of the inner stator 4A is disposed between the inner circumferential surface of the inner stator 4A and the outer circumferential surface of the frame 1 on which the inner stator 4A is press-fitted so as to prevent the frame 1 from being scratched in fitting the inner stator 4A, and thereby, the burr generation due to the scratch between the frame 1 and the inner stator 4A in press-fitting the inner stator 4A can be prevented. At the same time, even if the burr is generated, the burr is pushed into the escape unit 21 of the burr shielding ring 20 and locked therein. Therefore, the damage of the compressor can be prevented in advance by preventing the burr flowing into the compression chamber of the compression unit or into respective sliding portion.

Also, as described above, the abrasion of outer circumferential surface of the frame 1 in press-fitting the inner stator 4A on the frame 1 can be reduced to the minimum level, and therefore, the original fabrication level for the frame 1 and the inner stator 4A can be maintained and the inner stator 4A can be firmly assembled on the frame 1.

Figure 8:
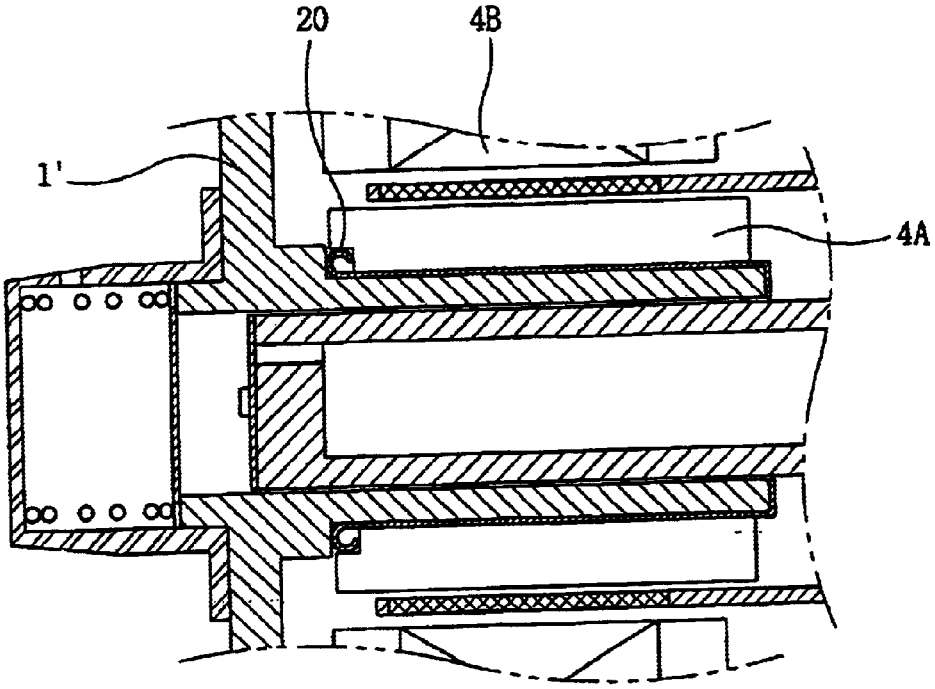
FIG. 8 is a brief cross-sectional view showing a reciprocating compressor in which a frame and a cylinder are integrated applied by the present invention.

Also, as shown in FIG. 8, the scratch protection cap 10 and the burr shielding ring 20 can be applied to a new frame 1' in which the frame 1 and the cylinder 3 are formed integrally with each other in dicasting method.

Figure 9:
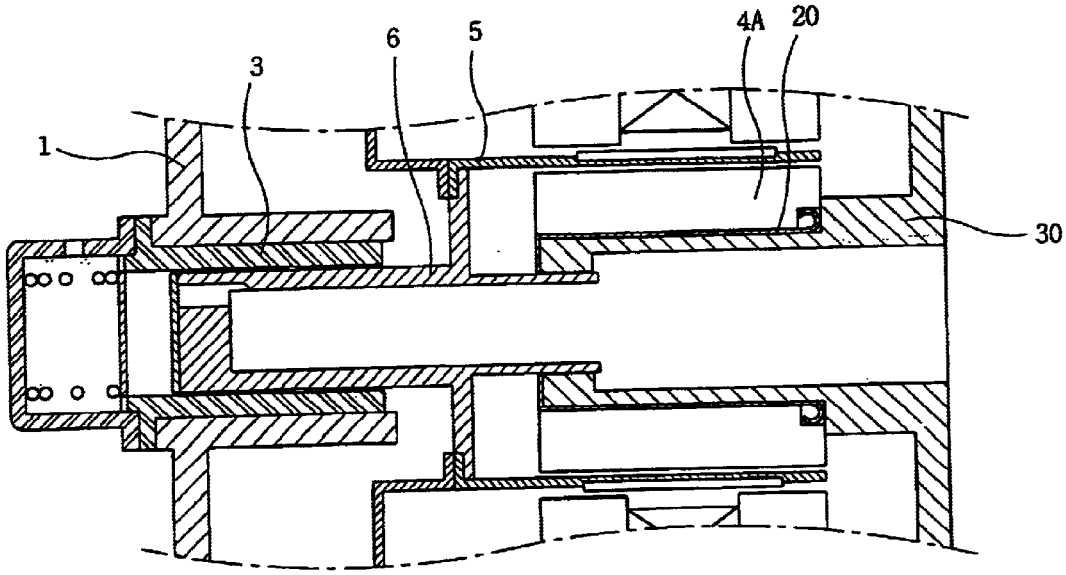
FIG. 9 is a brief cross-sectional view showing a reciprocating compressor having a slightly different structure applied by the present invention.

Also, as shown in FIG. 9, the scratch protection cap 10 and the burr shielding ring 20 may be disposed between the inner stator 4A and a through path pipe 30 in a reciprocating compressor having slightly different inner structure. In addition, as in FIG. 8, it is obvious that the scratch protection cap 10 and the burr shielding ring 20 can be also applied to the case in which the frame 1 and the through path pipe 30 are formed integrally with each other.

INDUSTRIAL APPLICABILITY

As so far described, according to the stator fixing structure in the reciprocating compressor of the present invention, a plurality of stator cores are laminated as a cylinder in radial direction to form the inner stator, and the inner stator is fixed on the frame by press-fitting it. In addition, the scratch preventing member of cylindrical shape is disposed between the inner circumferential surface of the inner stator and the outer circumferential surface of the frame corresponding thereto, and thereby, the burr generation due to the scratch between the frame and the inner stator can be prevented in advance. Accordingly, degradation of the valve function or abrasion of the sliding portion in the compression unit due to the burr can be prevented, and at the same time, the frame and the inner stator can be assembled firmly to reduce the vibration noise of the compressor.

Also, the burr shielding ring including the burr escape unit is disposed between the inner circumferential surface of the inner stator and the outer circumferential surface of the frame corresponding thereto, and thereby, the burr generation due to the scratch between the frame and the inner stator can be prevented in advance. At the same time, even if the burr is generated, the generated burr is locked in the burr escape unit. Accordingly, degradation of the valve function or abrasion of the sliding portion in the compression unit due to the burr can be prevented, and at the same time, the frame and the inner stator can be assembled firmly to reduce the vibration noise of the compressor.

What is claimed is:

1. A reciprocating compressor comprising:

an inner stator including a plurality of laminated stator cores arranged in a radial direction and forming a hollow cylinder;

a supporting member supporting said inner stator; and an intermediate member being arranged between the inner stator and the supporting member which supports the inner stator, said intermediate member preventing mutual abrasion between the inner stator and the supporting member, wherein the intermediate member is made of a material harder than that of the supporting member.

2. A reciprocating compressor comprising:

an outer stator;

an inner stator including a plurality of laminated stator cores arranged in a radial direction and forming a hollow cylinder;

a reciprocating armature being positioned between said inner stator and said outer stator and operatively supporting a reciprocating piston;

a supporting member supporting said inner stator on an outer circumferential surface thereof and supporting a cylinder on an inner circumferential surface thereof, said reciprocating piston operatively engaging said cylinder; and an intermediate member being arranged between the inner stator and the supporting member which supports the inner stator, said intermediate member preventing mutual abrasion between the inner stator and the supporting member, wherein the intermediate member is disposed between the inner circumferential surface of the inner stator and the outer circumferential surface of the supporting member for supporting the inner stator and is formed in a hollow cylindrical shape, said intermediate member further including a burr shielding ring having a rolled portion on an end portion thereof.

3. A reciprocating compressor comprising:

an inner stator including a plurality of laminated stator cores arranged in a radial direction and forming a hollow cylinder;

a supporting member supporting said inner staor; and an intermediate member being arranged between the inner stator and the supporting member which supports the inner stator, said intermediate member preventing mutual abrasion between the inner stator and the supporting member, wherein the intermediate member comprises an outwardly curved portion on a side of an inlet portion to which the inner stator is press-fitted.

4. The reciprocating compressor according to claim 1, wherein said supporting member is a boss portion of a support frame.

5. The reciprocating compressor according to claim 3, wherein said supporting member is a boss portion of a support frame.

6. The reciprocating compressor according to claim 5, wherein said intermediate member is a scratch resistant cap having a radially extending lip on an end portion thereof, said radially extending lip supporting said inner stator and engaging said boss portion of the support frame.

* * * * *